United States Patent [19]

Long et al.

[11] 4,439,129

[45] Mar. 27, 1984

[54] HYDRAULIC REFRACTORY PRESS INCLUDING FLOATING UPPER AND LOWER PLUNGER ASSEMBLIES

[75] Inventors: Gary R. Long, Bolingbrook; Hideo Okunami, Calumet Park, both of Ill.

[73] Assignee: Wehr Corporation, Milwaukee, Wis.

[21] Appl. No.: 436,698

[22] Filed: Oct. 26, 1982

[51] Int. Cl.[3] ..... B30B 11/04; B30B 1/32

[52] U.S. Cl. ..... 425/352; 425/411; 425/422; 425/167; 425/150

[58] Field of Search ..... 425/78, 119, 162, 167, 425/411, 415, 422, 352, 354, 355

[56] References Cited

U.S. PATENT DOCUMENTS

| | | | |
|---|---|---|---|
| 2,825,092 | 3/1958 | Hatch et al. | 425/78 |
| 3,078,540 | 2/1963 | Bush | 425/78 |
| 3,132,379 | 5/1964 | Crane | 425/78 |
| 3,191,232 | 6/1965 | Haller | 425/78 |
| 3,203,049 | 8/1965 | Brown et al. | 425/119 |
| 3,447,207 | 6/1969 | Dorsey | 425/422 X |
| 3,868,201 | 2/1975 | Jacobson et al. | 425/78 |
| 4,000,231 | 12/1976 | Peterson | 425/78 X |
| 4,260,346 | 4/1981 | Anderson et al. | 425/352 X |
| 4,265,610 | 5/1981 | Dorsey | 425/411 |
| 4,289,472 | 9/1981 | Dorsey | 425/422 X |
| 4,373,889 | 2/1983 | Brown | 425/150 |
| 4,392,800 | 7/1983 | Apuzzo | 425/78 |

*Primary Examiner*—J. Howard Flint, Jr.

[57] ABSTRACT

A hydraulic press for refractory material including a mold box rigidly supported by a press frame. A lower plunger assembly positioned below the mold box and includes a lower crosshead and at least one plunger adapted to extend upwardly into a vertical mold cavity in the mold box. An ejection cylinder assembly supported by the press crown is provided for causing selective vertical movement of the lower crosshead. An upper plunger assembly is positioned above the mold box and includes an upper crosshead and at least one upper plunger supported by the crosshead and adapted to extend downwardly into the mold cavity. A hydraulic cylinder is provided for supporting the upper crosshead for vertical movement with respect to the mold box and the lower crosshead. The hydraulic cylinder is fixedly connected to the lower crosshead, and a ram is housed in the cylinder and adapted to selectively drive the upper crosshead downwardly.

6 Claims, 4 Drawing Figures

HYDRAULIC REFRACTORY PRESS INCLUDING FLOATING UPPER AND LOWER PLUNGER ASSEMBLIES

FIELD OF THE INVENTION

The present invention relates to presses of the type for use in compressing refractory material such as are used in making bricks, and more particularly relates to hydraulic presses for such use.

BACKGROUND OF THE INVENTION

Prior art refractory presses commonly include a rigid frame having a mold table supported by the frame for vertical movement. An example of a typical prior art refractory brick press is illustrated in the Dorsey U.S. Pat. Nos. 3,447,205 and 4,265,610. In such brick presses the mold table fixedly supports a mold box having a plurality of vertical mold cavities, and a lower plunger assembly is fixed to the frame and includes a plurality of plungers adapted to project upwardly into the mold cavities. Such presses also commonly include an upper plunger assembly including a plurality of downwardly extending plungers, and a ram is provided to cause downward movement of the upper plunger assembly so that refractory material in the mold cavities can be compressed between the upper and lower plungers.

One of the effects of having fixed lower plungers and compression by the upper plungers is that the density of the resultant compressed refractory material tends to be greater in some parts of the brick than in other parts of the brick.

It is common that the mold cavities of mold boxes employed in refractory presses have a depth of twelve to sixteen inches, whereas the brick to be formed may be only three inches in thickness. It will be appreciated that compression of the refractory material results in wear of the walls of the mold cavity and that this wear is particularly significant in the area where the pressure on the refractory material is the greatest. Accordingly, in many prior art presses the wear of the mold cavities is not uniform and the mold boxes tend to wear in the specific area where the finished brick is formed.

SUMMARY OF THE INVENTION

The present invention includes an improved refractory press, the press components being hydraulically operated and including a frame and a mold box fixedly supported by the frame and including at least one vertically extending mold cavity. A lower plunger assembly is positioned below the mold box and includes a plunger adapted to extend upwardly into the mold cavity, and means are provided for supporting the lower plunger assembly for selective vertical reciprocal movement with respect to the mold box. An upper plunger assembly is positioned above the mold box and includes a plunger adapted to extend downwardly into the mold cavity, and means are provided for causing selective vertical movement of the upper plunger assembly with respect to the mold box and the lower plunger assembly, the means for causing selective movement of the upper plunger assembly including a ram and a cylinder, one of the ram and the cylinder being fixedly connected to the lower plunger assembly so as to move with the lower plunger assembly, and the other of the ram and the cylinder being operably connected to the upper plunger assembly to cause movement of the upper plunger assembly.

The invention also includes a hydraulic press including a frame having a pair of spaced-apart vertical side members and a crown, and a mold box rigidly supported between the vertical side members and including at least one vertically extending mold cavity. The press also includes a lower plunger assembly positioned below the mold box and having a lower crosshead and at least one plunger supported by the lower crosshead and adapted to extend upwardly into the mold cavity. Means are also provided for causing selective vertical movement of the lower crosshead, this means including an ejection cylinder assembly supported by the press crown. An upper plunger assembly is positioned above the mold box and includes an upper crosshead and at least one upper plunger supported by the crosshead and adapted to extend downwardly into the mold cavity. Means are also provided for supporting the upper crosshead for vertical movement with respect to the mold box and the lower crosshead, this means including a hydraulic cylinder, means for fixidly connecting the hydraulic cylinder to the lower crosshead, a ram housed in the cylinder and adapted to selectively drive the upper crosshead downwardly, and a kicker cylinder assembly.

One of the particular features of the hydraulic press embodying this construction is that the lower plunger assembly and the main ram hydraulic cylinder are fixedly connected and that the upper and lower plunger assemblies are allowed to "float" during compression by the main ram so as to permit equal compressive force to be applied by the upper and lower plungers thereby providing a product of substantially uniform density.

Another of the principal features of the hydraulic press embodying the invention is that the relative position of the plungers with respect to the mold table can be controlled or selected such that compression can take place in different zones or areas of the mold cavities so that wear of the mold cavity can be distributed equally and will not be localized to one portion of the side walls of the mold cavity.

Another principal feature of the hydraulic press apparatus embodying the invention is that hydraulic circuitry is provided, which in combination with the press construction and the relationship of the hydraulic rams, facilitates high speed operation and efficient use of the hydraulic power supplied. More specifically, two hydraulic pressure sources are provided. One of the hydraulic pumps is operably connected to the hydraulic cylinders controlling movement of the lower crosshead and lower plunger assembly. The other hydraulic pump is operably connected to the hydraulic cylinders and rams controlling movement of the upper crosshead and plunger assembly. Means are also provided for selectively connecting the two hydraulic pressure sources so that both pumps can be used to provide hydraulic pressure to the main ram during the compression of the refractory material but be connected to independent hydraulic cylinders during ejection of the formed bricks.

Another advantage of the apparatus of the invention is that the press can be constructed such that all of the hydraulic components can be mounted above the floor as compared to below the press in many prior art constructions. This provides for increased accessability of the hydraulic components and also permits installation of the press without the construction of an extensive concrete pit in the shop floor.

Another feature of the press embodying the invention is that it facilitates the use of hydraulic pressure sensing transducers whereby the pressure used in forming the bricks can be sensed and controlled and the pressure used in ejecting the bricks can also be regulated.

Another feature of the construction of the press embodying the invention is that the lower plungers can be positioned with their upper surfaces flush with the upper surface of the mold box when the refractory material charger is positioned over the mold box. The lower plungers can then be moved downwardly as the refractory material is deposited in the mold cavities to thereby provide a controlled and uniform filling of the mold cavities. Gradual and uniform filling of the mold cavities tends to provide a brick having a more uniform density.

Various other features of the invention will be apparent from the following description of a preferred embodiment, from the claims, and from the drawings.

Figure 1:
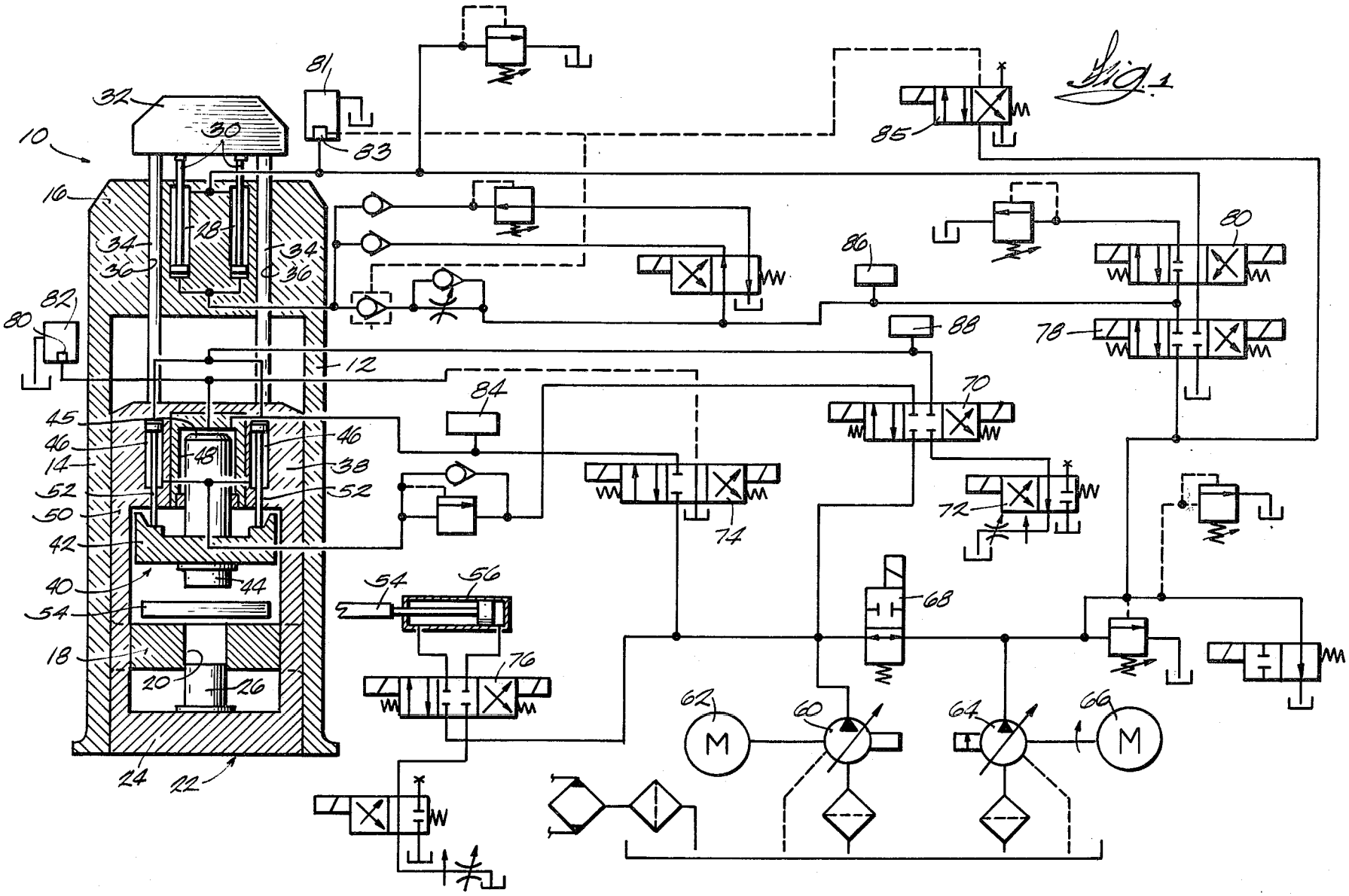
FIG. 1 is a schematic elevation view of a hydraulic press embodying the invention and a schematic illustration of the hydraulic circuitry of the press.

Before describing the preferred embodiments of the invention in detail, it is to be understood that the invention is not limited in its application to the details of construction or arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

The present invention includes a press 10 for refractory material having an improved arrangement for providing compression of the refractory material in the mold cavity. More specifically, the press 10 which is illustrated schematically in FIG. 1, includes a hydraulic ram arrangement providing for movement of both the upper and lower plungers into compressive engagement with refractory material contained in the mold cavities of a fixed mold box by providing controlled movement of both the upper and lower plunger assemblies. The refractory material in the mold cavities can be compressed in a manner which provides more uniform density of the resultant refractory product and also permits control of the compression of the refractory product to permit the press operator to control the product density of the brick.

More particularly, the press apparatus embodying the invention includes a frame 12 comprised of a pair of vertical side members 14 joined at their upper ends by a crown 16. A mold table 18 is fixedly supported by the vertical side members 14 and the mold table 18 supports a mold box, the mold box including at least one vertical mold cavity 20 open at its upper and lower ends. A lower plunger assembly 22 is positioned beneath the mold table 18 and includes a lower crosshead 24 supporting at least one plunger 26 adapted to extend upwardly into the mold cavity 20.

Means are also provided for causing selective vertical movement of the lower plunger assembly 22. In the illustrated arrangement, this means includes a pair of hydraulic cylinders 28 hereinafter referred to as ejection cylinders. Referring more particularly to the means for causing vertical movement of the lower crosshead, the ejection cylinders 28 are fixedly supported by the crown 16 of the press frame 12 and a pair of upwardly extending hydraulic pistons 30 are housed in the cylinders 28, the pistons 30 including upper ends joined to a press yoke 32. Tie rods 34 are fixed to the yoke 32 and extend downwardly through bores 36 in the crown 16, the tie rods 34 having lower ends fixed to the main ram cylinder body 38.

An upper plunger assembly 40 is positioned above the mold table 18 and includes an upper crosshead 42 supporting at least one downwardly extending plunger 44 adapted to be received in an upper portion of the mold cavity 20. Means are also provided for supporting the upper plunger assembly 40 for selective vertical movement with respect to the mold table 18 and with respect to the lower plunger assembly 22. While this means for causing movement of the upper plunger assembly 40 could have various constructions, in the illustrated construction it includes a main ram 45 and a pair of kicker cylinders 46. The main ram 45 includes a cylinder 48 and a ram piston having a lower end joined to the upper crosshead 42 so as to provide vertical reciprocal movement of the upper crosshead. The main ram cylinder body 38 is supported by the frame 12 for vertical reciprocal movement and is fixedly joined to the lower crosshead 24 by vertical side bars 50 such that the main ram cylinder body 38 and the lower crosshead 24 will move in unison with respect to the press frame 12 and with respect to the mold table 18. The kicker cylinders 46 each include a cylinder fixed to the main ram cylinder body 38 and a downwardly extending piston 52 having a lower end joined to the upper crosshead 42.

Figure 3:
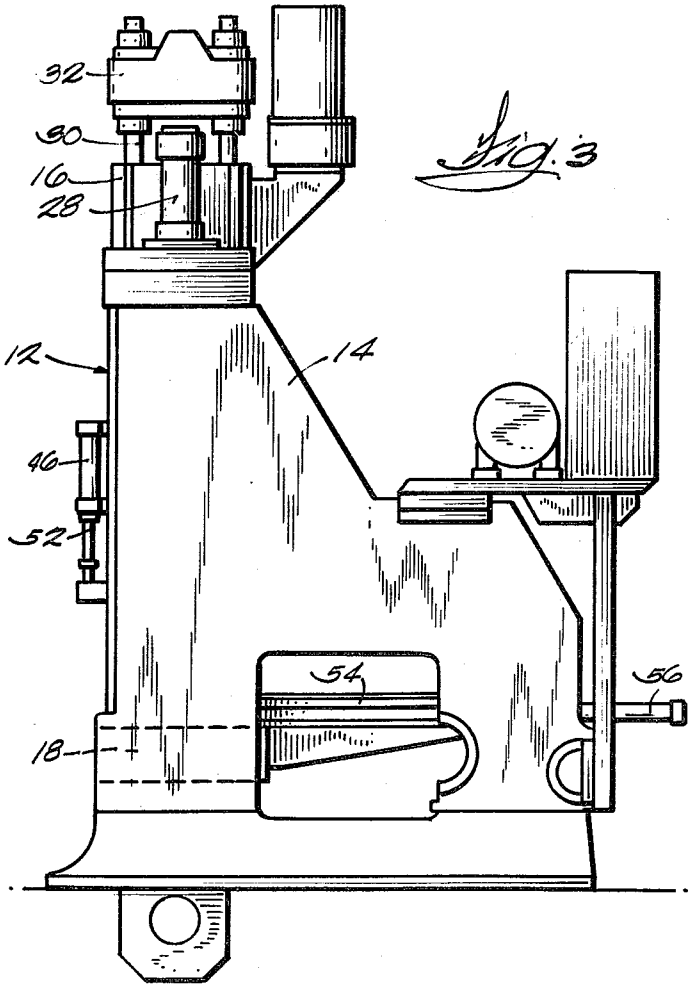
FIG. 3. is a side elevation view of the press shown in FIG. 2.
Figure 4:
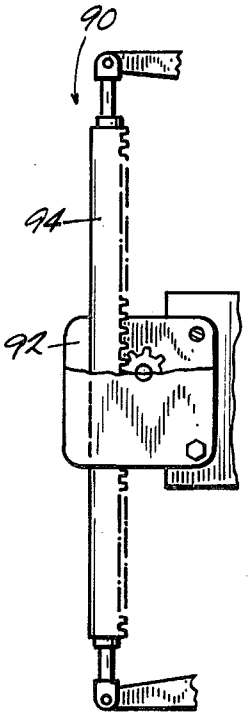
FIG. 4 is an enlarged elevation view of a vertical position sensing device embodied in the hydraulic press shown in FIGS. 1–3.
Figure 2:
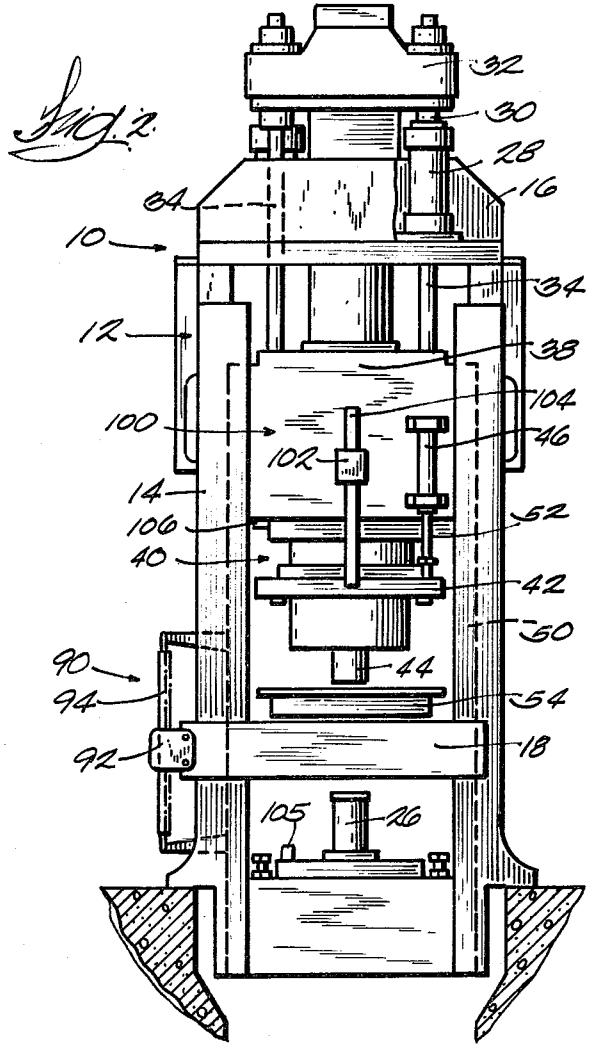
FIG. 2 is a front elevation view of the press shown in FIG. 1.

Means are also provided for depositing a selected amount or charge of refractory material in the mold cavity 20. This means includes a horizontally reciprocable charger 54, best shown in FIGS. 2 and 3. The charger 54 has a conventional construction and will not be described in detail. The charger 54 can be driven between a retracted position as shown in FIG. 3 to a forward position wherein refractory material is deposited in the mold cavity 20. The charger 54 is driven in this horizontal reciprocable manner by a horizontally positioned charger cylinder 56.

FIG. 1 further includes a schematic illustration of hydraulic circuitry which can be employed in operation of the hydraulic press 10 embodying the present invention. Since the illustrated hydraulic components are conventional, their construction and operation will not be described in detail. The illustrated hydraulic equipment includes a strokable variable volume, variable pressure pump 60 driven by a motor 62 and a similar strokable, variable volume variable pressure pump 64 driven by a motor 66. The outputs of the pumps 60 and 64 are connected by a flow separator valve 68 to be described in greater detail hereinafter. The output of pump 60 is also connected through a kicker cylinder control valve 70 and a kicker cylinder speed control valve 72 to the kicker cylinders 46. The output of the pump 60 is also connected through a main ram control valve 74 to the cylinder 48 of the main ram. The pump 60 is also connected through a charger cylinder control valve 76 to the charger cylinder 56. The other variable volume variable pressure pump 64 is connected through ejection cylinder control valves 78 and 79 to the ejection cylinders 28. The ejection cylinders 28 are also connected to a hydraulic fluid tank 81 by a prefill valve 83, and the prefill valve 83 is operably connected to a prefill control valve 85.

In operation of the press apparatus illustrated in FIG. 1, the pressing cycle can be commenced by actuating the ejection cylinders 28 to cause upward movement of the main ram cylinder body 38 and the lower crosshead 24 such that the lower plunger 28 is positioned in the mold cavity 20, and with the upper surface of the lower plunger 26 aligned with the upper surface of the mold box of the mold table 18.

The charger 54 is then moved from its retracted position to a mold charging position by actuation of the charger cylinder 56. When the charger 54 is properly positioned over the mold cavity 20, the ejection cylinders 28 are actuated to cause downward movement of the lower plungers 26 and filling of the mold cavities with the required quantity of refractory material. The charger cylinder 56 is then actuated to cause retraction of the charger 54 to the position shown in FIG. 3.

Once the mold cavity 20 has been filled, a prefill valve 80 is actuated to cause a high volume of hydraulic fluid to flow from a tank 82 into the main ram cylinder 48, and the kicker cylinders 46 are actuated to permit downward movement of the upper crosshead 42. This provides for an initial compression or "deairing" of the refractory material in the mold cavity 20. The hydraulic circuitry can then be electrically controlled so as to maintain the upper plunger 44 in the deairing position for a predetermined period of time as selected by the operator and depending on the type of refractory product being made.

One of the features of the invention is that since the press is hydraulic and is controlled by electrically operated hydraulic valves, the press operator can select the deairing pressure applied by the kicker cylinders, and the length of time of the deairing step. The operator can also cause the upper plunger 44 to move down into the deairing position and hold the plunger 44 in this position, or he can cause the upper plunger to "bump" the refractory material and then withdraw the upper plunger.

Following the deairing step, the main ram control valve 74 is actuated to cause hydraulic fluid to be provided to the main ram cylinder 48 and to thereby cause compression of the refractory material in the mold cavity 20. During this step of the operation of the press, the flow selector valve 68 can cause the output of both of the variable volume variable pressure pumps 60 and 64 to be applied to the main ram cylinder 48.

During the compression step, the ejection cylinders 28 can also be controlled so as to provide only sufficient force as to support the weight of the lower crosshead 24, the upper crosshead 42, and the main ram cylinder assembly 38. If the upper and lower plunger assemblies 22 and 40 are supported by the ejection cylinders 28 in this manner, and since the main ram cylinder is fixedly connected to the lower plunger assembly 22, the lower plungers 26 will apply an upward force on the refractory material equal to the downward force on the refractory material applied by the upper plunger 44. This "floating" of the upper and lower plungers with respect to the mold table will result in generally equal compressive force being applied to both the upper and lower portions of the refractory material to thereby provide a relatively uniform density of the resultant refractory product.

It will be appreciated that in other applications of the hydraulic press embodying the invention, the operator may desire to apply greater pressure on the lower portions of the refractory materials so as to generate greater density in that region. In such a case, as the main ram 45 applies compressive force on the refractory material, the ejection cylinders 28 can be caused to apply an upward force on the lower plunger 28. Similarly, if the operator desires to apply a greater pressure with the upper plunger 44 than with the lower plunger 26, the ejection cylinders 28 can be caused to apply downward force.

Following the compression of the refractory material, the prefill valve 80 is opened and the kicker cylinders 46 are actuated to raise the upper crosshead 42. The ejection cylinders 28 are then actuated to cause upward movement of the lower plunger 26 so as to eject the finished brick from the mold cavity 20. The press is then in condition to repeat the operating cycle.

One of the advantages of the provision of the pair of fluid pumps 60 and 64 and the flow separator 68 is that during parts of the press operation, the two pumps 60 and 64 can be working together, and during other parts of the press operation, the pumps 60 and 64 can be operably connected to different hydraulic elements so as to accomplish different functions. In other words, when high pressure and high volume hydraulic fluid is required, the pumps 60 and 64 are operated together. When the press calls for high pressure and low volume, one pump will be providing hydraulic fluid to one function of the press and the other pump may be coasting. During other parts of the press operation both pumps may be working independently with the flow separator 68 being closed. For example, once the pressing operation is completed and the press is open to provide for ejection of the bricks, it is desirable to provide for upward movement of the upper plunger 44 at the same time as ejection of the bricks. Ejection of the bricks requires a high pressure low volume output from one of the pumps in the ejection cylinders 28 to cause the bricks to break loose of the die cavity walls. The other pump provides a high volume low pressure output to the kicker cylinders 48 to thereby cause a rapid retraction of the upper plunger assembly 40.

Another feature of the press construction is that the ejection cylinders 28 can be controlled so as to cause the lower plungers to move downwardly incrementally during successive press cycles. More particularly, the press is controlled such that the pressing operation of a first brick will be in an upper portion of the mold cavity 20 and then with each successive pressing cycle, compression takes place further down in the mold cavity until the pressing cycle takes place in a bottom portion of the mold box. This feature facilitates longer wear life of the mold box since it results in more uniform wear of the mold cavity walls.

Another of the features of the invention is that pressure transducers 84, 86, and 88 can be employed to provide an output of the hydraulic pressure being generated by the main ram 45, by the ejection cylinders 28, and by the kicker cylinders 46. The use of such pressure transducers can be employed to provide electronic control of the press operation and also permits the operator to control the pressure being applied during the deairing step, the pressure applied during the compression step and the pressure applied by the ejection cylinders to accomplish ejection of the bricks.

Various features of the invention are set forth in the following claims.

We claim:

1. A hydraulic press comprising a frame including a pair of spaced-apart vertical side members and a crown, a mold box rigidly supported between said vertical members, said mold box including at least one vertically extending mold cavity, a lower plunger assembly positioned below said mold box, said lower plunger assembly including a lower crosshead and at least one plunger supported by said lower crosshead and adapted to extend upwardly into said mold cavity, means for causing selective vertical movement of said lower crosshead, said means including an ejection cylinder assembly supported by said crown, an upper plunger assembly positioned above said mold box and including an upper crosshead and at least one upper plunger supported by said crosshead and adapted to extend downwardly into said mold cavity, means for supporting said upper crosshead for vertical movement with respect to said mold box and said lower crosshead including a hydraulic cylinder, means for fixidly connecting said hydraulic cylinder to said lower crosshead, a ram housed in said cylinder and adapted to selectively drive said upper crosshead downwardly, and a kicker cylinder assembly, a first fluid pressure source and a second fluid pressure source, and means for selectively connecting said first fluid pressure source to said ejection cylinder and to said hydraulic cylinder and for selectively connecting said second fluid pressure source to said ejection cylinder and said hydraulic cylinder, said means for selectively connecting includes a flow separator valve positioned between said first fluid pressure source and said second fluid pressure source, said first fluid pressure source is a first variable volume variable pressure pump and wherein said second fluid pressure source is a second variable volume variable pressure pump.

2. A hydraulic press as set forth in claim 1 wherein said means for causing selective vertical movement of said upper plunger assembly includes a cylinder body positioned above said upper plunger assembly, said cylinder body including said cylinder, and wherein said ram is operably connected to said upper plunger assembly, and further including means for rigidly joining said cylinder body to said lower plunger assembly for movement with said lower plunger assembly.

3. A hydraulic press as set forth in claim 1 wherein said means for causing selective vertical movement of said lower plunger assembly includes a second cylinder and a piston housed in said second cylinder, one of said piston and said second cylinder being fixed to said frame, and the other of said piston and said second cylinder being connected to said lower plunger assembly.

4. A hydraulic press as set forth in claim 3 wherein said piston and said second cylinder are mounted above said upper assembly.

5. A hydraulic press as set forth in claim 1 wherein said upper plunger assembly includes an upper crosshead supporting said upper plunger, and wherein said means for causing selective movement of said upper crosshead includes a main cylinder fixedly joined to said lower plunger assembly and a ram housed in said cylinder and operably connected to said upper crosshead.

6. A hydraulic press as set forth in claim 1 and further including means for controlling said means for causing selective movement of said upper plunger assembly, said means for controlling including means for causing simultaneous movement of said upper plunger assembly and said lower plunger assembly into compressing relation with refractory material in said mold cavity.

* * * * *